United States Patent [19]

Frey, Jr.

[11] 4,205,296

[45] May 27, 1980

[54] RHEOSTAT TRIMMER

[75] Inventor: Sydney W. Frey, Jr., Brookfield, Wis.

[73] Assignee: Allen-Bradley Company, Milwaukee, Wis.

[21] Appl. No.: 949,526

[22] Filed: Oct. 10, 1978

[51] Int. Cl.[2] ..... H01C 10/26

[52] U.S. Cl. ..... 338/150; 338/171; 338/174

[58] Field of Search ..... 338/68, 118, 137, 150, 338/160, 162, 171, 174, 188, 202; 29/610

[56] References Cited

U.S. PATENT DOCUMENTS

| | | | |
|---|---|---|---|
| 2,857,496 | 10/1958 | Louis | 338/199 X |
| 2,899,662 | 8/1959 | Barden et al. | 338/174 |
| 3,375,478 | 3/1968 | Van Benthuysen et al. | 338/174 |
| 3,469,311 | 9/1969 | Van Benthuysen et al. | 29/620 |
| 3,484,734 | 12/1969 | Casey et al. | 338/162 |
| 3,657,688 | 4/1972 | Casey et al. | 338/150 |
| 3,855,565 | 12/1974 | Robinson et al. | 338/171 |

*Primary Examiner*—C. L. Albritton
*Attorney, Agent, or Firm*—Quarles & Brady

[57] ABSTRACT

A rheostat (10) has a disk-shaped base (11) that is slidably mounted between a pair of spaced terminal pins (12, 13). A resistance track (14) is disposed on top of the base (11) and is connected to a collector track (15) that is disposed around the circumference of the base (11). A collector terminal pin (12) has contacts (**12*d*) in sliding engagement with the collector track (15), and a wiper terminal pin (13) has an oblique contact surface formed by projections (13*g*) that slidably engage the resistance track (14). The terminal pins (12, 13) can be mounted on a supporting surface, so that as the base (11) is rotated, the resistance between the terminal pins (12, 13) is varied. The oblique contact surface on the wiper terminal pin (13) aids in maintaining a balanced current distribution in the resistance track (14**).

11 Claims, 5 Drawing Figures

RHEOSTAT TRIMMER

TECHNICAL FIELD

The field of the invention is variable resistor controls, and more particularly, rheostats.

BACKGROUND ART

Variable resistor controls in the prior art are most commonly of the three-terminal type which can be used as either potentiometers or rheostats. When such a device is used as a rheostat, only two of the three terminals are employed in making connections within an electrical circuit. An example of such a variable resistor is disclosed in Casey et al, U.S. Pat. No. 3,657,688, issued Apr. 18, 1972.

A type of variable resistor which is designed for infrequent adjustments, sometimes only a single adjustment, is referred to as a "trimming resistor" or simply a "trimmer." Several examples of such trimmers are disclosed in Denes, U.S. Pat. No. 4,100,525, issued July 11, 1978. FIGS. 1–3, each show a two-terminal device that may be set at the beginning of its operating life to obtain a desired resistance for that operating life. A second adjustment can be made, if desired, but only within a narrowed range of values determined by the first adjustment. Trimmers are usually mounted on a circuit board, and are not usually accessible on a control panel. Trimmers, like front panel controls, are available as three-terminal devices which can be used either as potentiometers or rheostats. A three-terminal trimmer is shown in FIG. 4 of U.S. Pat. No. 4,100,525 mentioned above.

It is common practice for manufacturers of electrical apparatus to stock a single trimmer in each electrical category for use as either a potentiometer or a rheostat. While a device that is to be used exclusively as a rheostat might be made at slightly lesser cost than a comparable device which must also function as a potentiometer, the potential administrative cost of stocking two devices, including the cost of stocking added inventory, has generally outweighed the potential cost savings. Thus, it is not enough for a trimmer that functions only as a rheostat to be slightly less expensive than a trimmer that can function as either a rheostat or a potentiometer; such a rheostat must clearly economize and eliminate nonessential details.

DISCLOSURE OF THE INVENTION

The present invention provides a two-terminal variable resistor control that functions as a rheostat, but not a potentiometer. The control has a base with a top surface, a peripheral side surface, and a track pattern disposed on these two surfaces. The base is rotatably mounted between a pair of spaced terminal pins, with one pin in sliding engagement with a resistance track, and with the other pin in sliding engagement with a collector track of negligible resistance. The terminal pins are mounted on a supporting surface, such as a printed circuit board, so that the base can be rotated, to vary the resistance that is electrically connected between the terminal pins.

More particularly, the control includes a base having top and bottom surfaces and a peripheral side surface extending between and joined to the top and bottom surfaces to form top and bottom peripheral edges, respectively. A resistance track is disposed on the top surface with an arcuate portion spaced inwardly from the top peripheral edge of the base, and with a termination portion extending outwardly from the arcuate portion to the top peripheral edge of the base. A collector track is disposed on the base along its peripheral side surface, the collector track and the termination portion of the resistance track being electrically connected along the top peripheral edge of the base. A pair of spaced terminal pins are adapted to slidably support the base for rotation therebetween. The first terminal pin includes a first contact that engages the collector track, and the second terminal pin includes a second contact that engages the arcuate portion of the resistance track. Therefore, the base can be rotated relative to the terminal pins to vary the resistance that is electrically connected between the terminal pins.

In a specific embodiment, the second contact is formed by a plurality of contact fingers disposed side by side and varying in length, each contact finger having a projection near a free end. The projection on the shortest contact finger engages the arcuate portion of the resistance track nearer to its outside edge, and the projection on the longest contact finger engages the arcuate portion of the resistance track nearer to its inside edge. Other contact fingers of intermediate length can be disposed between these two, and can be provided with projections that engage the arcuate portion of the resistance track between these first two engagements. The projections form an oblique contact surface that extends across the width of the arcuate resistance track.

The oblique disposition of this contact surface tends to balance the current which flows along the inside and outside edges of the arcuate resistance track. If the contact surface were disposed radially from the rotational axis of the base across the width of the resistance track, the current distributed along the inside edge of the resistance track would be greater than that along the outside edge, due to a shorter available resistance path. In this way, a portion of the resistance track might be overloaded even though the device was operating within its rated limits. Besides preventing this current imbalance, the oblique contact surface also provides a crossover connection between the ends of the resistance track as the second contact passes the maximum resistance position to prevent the device from going to an open circuit condition. The device is also protected against a short circuit condition by the termination portion of the resistance track when the oblique contact surface makes the crossover connection.

The invention not only provides advantages in electrical design, but also provides a device that can be manufactured simply and inexpensively. In the open-frame rheostat described more fully below, there are but three components to be assembled: the base, a collector terminal pin, and a wiper terminal pin. The circuit track pattern can be easily formed on the base with known materials and techniques.

It is one object of the invention to provide a rheostat that is significantly less expensive to manufacture and sell than devices which can be used as either a potentiometer or a rheostat.

It is another object of the invention to provide a rheostat that does not require a housing or contact-carrying members, other than a pair of contact-carrying terminal pins.

It is another object of the invention to provide a wiper contact for use with an arcuate resistance track that produces a more even distribution of current through the resistance track.

It is another object of the invention to maximize the use of the available surface area of the base.

The foregoing and other objects and advantages of the invention will appear from the following description. In the description reference is made to the accompanying drawing, which forms a part hereof, and in which there is shown by way of illustration a preferred embodiment of the invention. Such embodiment does not necessarily represent the full scope of the invention, however, and reference is therefore made to the claims herein for interpreting the scope of the invention.

BEST MODE OF CARRYING OUT THE INVENTION

Figure 1:
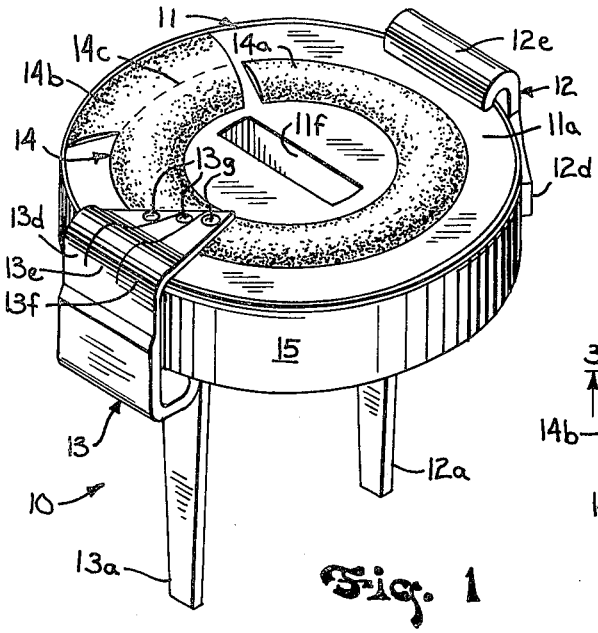
FIG. 1 is a view in perspective of the variable resistor control of the present invention.
Figure 2:
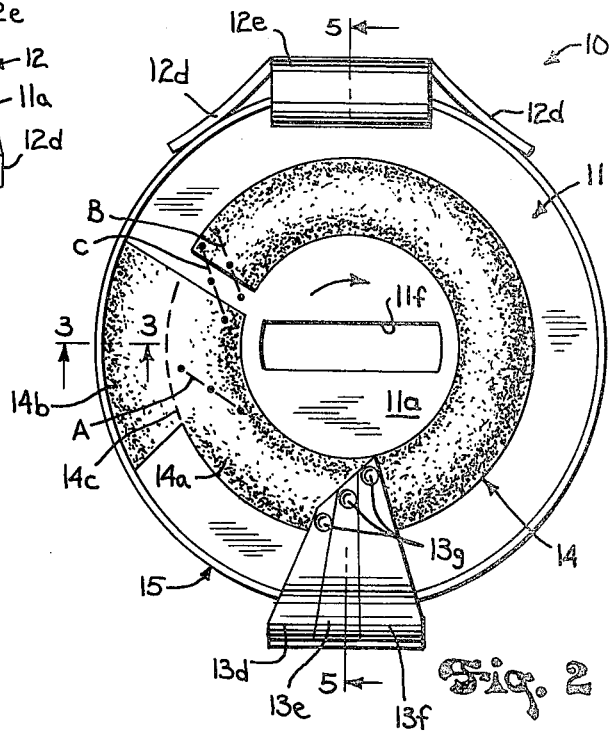
FIG. 2 is a top view of the control of FIG. 1.
Figure 3:
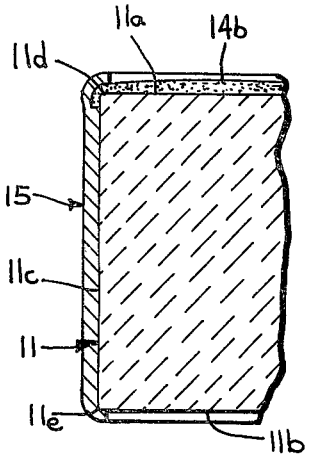
FIG. 3 is a detail view in a section taken in the plane indicated by lines 3—3 in FIG. 2.
Figure 4:
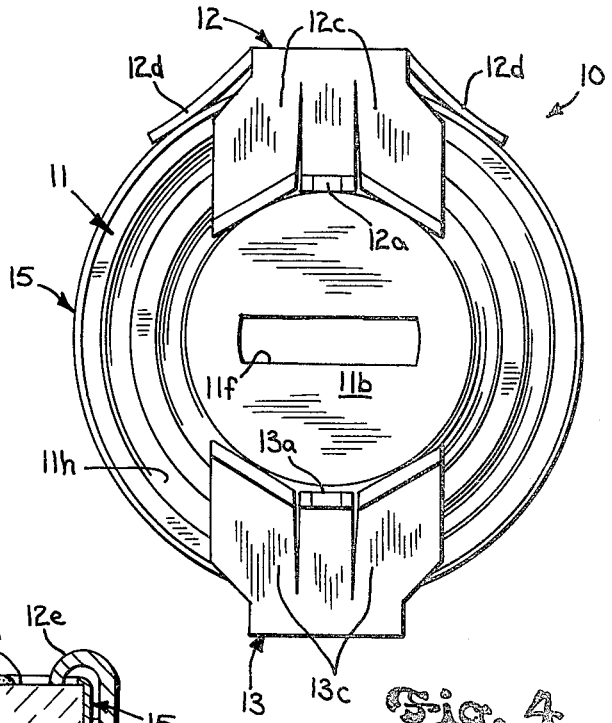
FIG. 4 is a bottom view of the control of FIG. 1.
Figure 5:
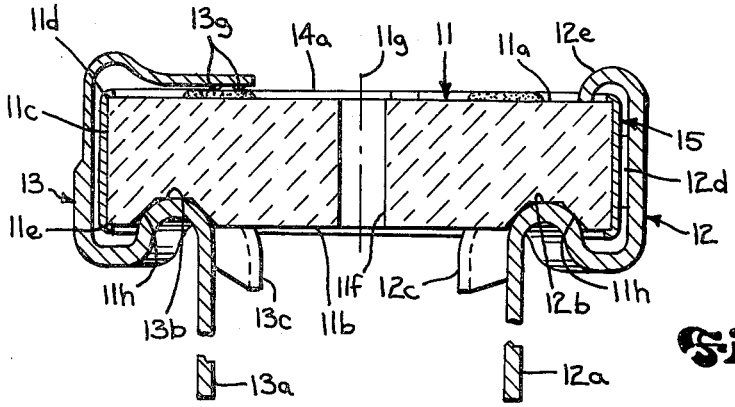
FIG. 5 is a sectional view taken in the plane indicated by lines 5—5 in FIG. 2.

Referring to FIGS. 1–5, an open-frame rheostat 10 that embodies the present invention includes a disk-shaped base 11 disposed between a collector terminal pin 12 and a wiper terminal pin 13. The base 11 is made of alumina and has a circular top surface 11*a* as seen in FIGS. 1 and 2, a circular bottom surface 11*b* as seen in FIG. 4, and a peripheral side surface 11*c*, seen in FIGS. 3 and 5, that extends around the circumference of the base 11 between the top and bottom surfaces 11*a*, 11*b*. The peripheral side surface 11*c* is joined to the top and bottom surfaces 11*a*, 11*b*, to form top and bottom peripheral edges, 11*d*, 11*e*, respectively, each edge also extending around the circumference of the base 11. A rectangular slot 11*f* extends through the base 11 between the top and bottom surfaces 11*a*, 11*b*, and is centered about an axis of rotation 11*g* for the base 11, shown in FIG. 5. As seen in FIGS. 4 and 5, the base 11 also has an annular groove 11*h* formed in its bottom surface 11*b*. The width of the groove 11*h* tapers from wide to narrow as it extends into the base 11 from the bottom surface 11*b*.

Referring particularly to FIGS. 1 and 2, a resistance track 14 is disposed on the top surface 11*a* of the base 11 and has an arcuate portion 14*a* spaced radially inward from the top peripheral edge 11*d*. The arcuate portion 14*a* extends almost completely around the base 11, but a relatively narrow gap separates its ends to prevent it from forming a complete ring. A termination portion 14*b* of the resistance track 14 extends from one end of the arcuate portion 14*a* to the top peripheral edge of the base 11. The two portions 14*a*, 14*b* of the resistance track 14 are defined for purposes of this description by a dashed line 14*c* in FIGS. 1 and 2. A collector track 15 is formed on, and completely covers, the peripheral surface 11*c* of the base 11. In the drawing the thicknesses of these tracks 14, 15 have been exaggerated to more clearly disclose this embodiment of the invention.

The resistance track 14 is made of a cermet material, which is a matrix of metal and metal oxides dispersed in a glass medium. The material is applied as an ink that includes an organic carrier. The ink is selected to provide a known resistance per unit area per mil thickness. The collector track 15 is also a cermet material that is applied as an ink. Besides an organic carrier, a constituent of this ink is a silver powder of the type commonly available, which imparts good conductivity and negligible resistance to the collector track 15. In applying the ink to the peripheral side surface it is convenient to roll the disk-shaped base 11 on its side 11*c* through the ink. In applying the inks to the base 11 either one or both of the inks may be allowed to drift over the top peripheral edge 11*d* of the base 11 so that one track overlays the other in the region of the termination portion 14*b*. As seen in FIG. 3, each of the tracks 14, 15 has a portion extending over the top peripheral edge of the base 11 onto the supporting surface of the other, with the collector track 15 being applied last to overlay an edge of the termination portion 14*b* of the resistance track 14. The pastes or inks forming the tracks 14, 15 are dried on the base to decompose their organic carriers, and are fired or co-fired on the base 11 in the manner well known in the art.

As seen in FIGS. 1, 4 and 5, the collector terminal pin 12 has a depending shank portion 12*a* for insertion into a supporting surface such as a circuit board (not shown). The shank 12*a* has a bend at its top which forms a knee 12*b* that fits in the tapered groove 11*h* in the base 11. On opposite sides of the knee 12*b* are stand-off supports 12*c* that provide added support for the rheostat 10 on the circuit board, and that maintain a space therebetween. A depending edge of each stand-off support 12*c* contacts the circuit board when the shank 12*a* is inserted therethrough to a sufficient depth. The knee 12*b* and the stand-off supports 12*c* are formed by a coining process, so that they will project into groove 11*b* and follow its curvature.

From the knee 12*b*, the collector terminal pin 12 extends radially outward and upward to wrap around the bottom edge 11*e* of the base 11. A pair of collector contacts 12*d* are integrally formed on this extending portion and they extend laterally therefrom to engage the collector track 15. As seen best in FIGS. 1 and 5, the top portion of the collector terminal pin 12 curls inwardly over the top edge 11*d* of the base 11 and down to the top surface 11*a* of the base 11 to form an abutment 12*e*, which holds one half of the base 11 on the knee 12*b* of the collector terminal pin 12.

As shown in FIGS. 1, 2, 4 and 5, spaced apart and opposite from the collector terminal pin 12 is a wiper terminal pin 13 with a shank 13*a*, a knee 13*b* formed at the top of the shank 13*a*, and a pair of stand-off supports 13*c* formed on opposite sides of the knee 13*b*. This knee 13*b* and these stand-off supports 13*c* support the other half of the base 11 and are also formed with a coining process so that they project into the groove 11*h* and follow its curvature. The wiper terminal pin 13 extends from its knee 13*b* around the bottom edge 11*e* of the base 11 and then upward, where it is split into three wiper contact fingers 13*d*–13*f*. The contact fingers 13*d*–13*f* extend over the top edge 11*d* of the base 11, and then converge downward towards the top surface 11*a* of the base 11. Each contact finger 13*d*–13*f* is dimpled near its free end to form a projection 13*g* which engages the resistance track 14. The contact fingers 13*d*–13*f* vary in length so that, as seen in FIG. 2, the left finger 13*d* contacts the resistance track 14 nearer to its outside edge than its inside edge. The right finger 13*f*, which is the longest, contacts the resistance track 14 nearer to its inside edge than its outside edge. The intermediate contact finger 13*e* contacts the resistance track 14 approximately midway between its edges. In this way the projections 13*g* on the wiper fingers 13*d*–13*f* form a linear contact surface that extends obliquely across the width of the resistance track 14 as seen in FIG. 2.

One advantage of the oblique contact surface formed by the contact projections 13*g* is a more even distribution of current through the arcuate portion 14*a* of the resistance track 14. If the linear contact surface formed by the projections 13*g* extended radially from rotational axis across the width of the arcuate resistance track 14, the resistive current path along the inside edge of the arcuate portion 14*a* would be shorter than the resistive current path along the outside edge of the arcuate portion 14*a*. Consequently, more current would be distributed along the outside edge of the arcuate portion 14 than along the inside edge. By obtaining a more even current distribution the device will be able to maximize its current-carrying capability. This is achieved with the oblique contact surface which increases the angle of the arcuate, resistive current path as it extends toward the inside edge of the resistance track 14.

The wiper terminal pin 13, like the collector terminal pin 12, is made of a tin-plated copper alloy. As seen in FIG. 5, the wiper contact fingers 13*d*–13*f* are thinner in cross section than the remaining portion of the wiper contact terminal pin 13 so that the contact fingers 13*d*–13*f* are resilient while the shank 13*a* and stand-off supports 13*c* are more rigid, to support the rheostat 10. The wiper contact fingers 13*d*–13*f* hold the base 11 in slidable position on the knee 13*b* of the wiper terminal pin 13. It should also be noticed in FIG. 5 that the top surface of the resistance track 14 is not necessarily flat. If this surface is not flat, the multiple contact fingers 13*d*–13*f* provide a wiper contact surface that conforms to the shape of the top surface of the resistance track 14.

In use, the rheostat 10 is mounted to a supporting surface such as a circuit board by inserting the terminal pins 12 and 13 into the circuit board and securing them by soldering, or other suitable means of electrical and mechanical connection. The base 11 is mounted substantially parallel to the mounting surface. The rheostat 10 can be adjusted by inserting a suitable rotatable drive member, such as a screwdriver, in the slot 11*f* and rotating the base 11 until the desired resistance between the terminal pins 12, 13 is obtained.

The position of the contact projections 13*g* is shown in FIG. 2 in phantom for settings of the rheostat designated A, B and C. In position A the wiper terminal 13 is at a minimum resistance position relative to the base 11. As the base 11 is rotated in a clockwise direction, symbolized by the arrow in FIG. 2, the wiper contact fingers 13*d*–13*f* change positions along the resistance track 14 to increase the resistance between the terminal pins 12, 13. When the contact fingers 13*d*–13*f* reach the end of the track, or a maximum resistance position B, there is no stop to prevent the base 11 from being rotated farther. This allows the further rotation of the base 11 to the minimum resistance position A by the shortest route. Where this is not desired, a stop can be employed. When no stop is present, and when the base 11 is rotated a little farther in the clockwise direction, the contact projections 13*g* reach position C with one projection 13*g* engaging the high resistance end of the resistance track 14 on one side of the gap and another projection 13*g* engaging the low resistance end of the resistance track 14 on the other side of the gap. Thus it is apparent that the rheostat 10 is not adjustable to either an open circuit position or a short circuit position, but instead, the rheostat 10 is switched from a maximum resistance to a minimum resistance as the wiper contact surface crosses the gap. It is not necessary, nor desirable, for the rheostat 10 to have either an open circuit or short circuit position, as either of these positions could cause unacceptable operating conditions in the circuit in which the rheostat 10 is connected.

The embodiments of the invention in which an exclusive property or privilege is claimed are defined as follows:

1. A variable resistor control, which comprises:

a base having top and bottom surfaces and a peripheral side surface extending between and joined to the top and bottom surfaces to form top and bottom peripheral edges, respectively;

a resistance track disposed on the top surface of the base with an arcuate portion spaced inwardly from the top peripheral edge of the base and with a termination portion extending outwardly from the arcuate portion to the top peripheral edge of the base;

a collector track disposed on the base along its peripheral side surface, the collector track and the termination portion of the resistance track being electrically connected along the top peripheral edge of the base; and a pair of spaced terminal pins adapted to slidably support the base for rotation therebetween, the first terminal pin including a first contact that engages the collector track, and the second terminal pin including a second contact that engages the arcuate portion of the resistance track, whereby the base can be rotated relative to the terminal pins to vary the resistance that is electrically connected between the terminal pins.

2. The control of claim 1, wherein the base includes an aperture adapted to receive a rotatable drive member.

3. The control of claim 1 wherein:

the base has an annular groove formed in its bottom surface; and wherein the terminal pins each have a knee adapted to project into the groove to slidably support the base for rotation, the wiper terminal pin having resilient wiper contact fingers that grip the base on its top side opposite the knee of the wiper terminal pin, and the collector terminal pin having an abutment that grips the base on its top side opposite the knee of the collector terminal pin.

4. The control of claim 1, wherein the second contact includes an oblique contact surface that engages the resistance track.

5. The control of claim 4, wherein:

the arcuate portion of the resistance track has opposite ends that are separated by a gap; and wherein the oblique contact surface is adapted to extend across the gap from one end of the arcuate portion to the other as the base is rotated.

6. The control of claim 4, wherein the second contact has a plurality of contact fingers which are positioned side by side and which are of different lengths, each contact finger having a free end with a projection formed thereon that forms part of the oblique contact surface.

7. The control of claim 1, wherein the collector track and the resistance track have portions extending along the top peripheral edge of the base which are overlaid one upon the other.

8. The control of claim 7, wherein the overlaying of the two tracks is on the top surface of the base.

9. The control of claim 7, wherein the overlaying of the two tracks is on the peripheral side surface of the base.

10. The control of claim 7, wherein the overlaying of the two tracks is on both the top and peripheral side surfaces of the base.

11. The control of claim 1, wherein the base is disk-shaped.

* * * * *